US008845959B2

(12) United States Patent
Hale et al.

(10) Patent No.: US 8,845,959 B2
(45) Date of Patent: Sep. 30, 2014

(54) GOLD-BASED ALLOY, FREE OF SILVER AND TIN, FOR DENTAL COPINGS OR ABUTMENTS

(75) Inventors: Peter Hale, Windsor, CT (US); Edward F. Smith, III, Madison, CT (US); Arthur S. Klein, Orange, CT (US)

(73) Assignee: Deringer-Ney, Inc., Bloomfield, CT (US)

( * ) Notice: Subject to any disclaimer, the term of this patent is extended or adjusted under 35 U.S.C. 154(b) by 270 days.

(21) Appl. No.: 13/050,657

(22) Filed: Mar. 17, 2011

(65) Prior Publication Data

US 2012/0039744 A1 Feb. 16, 2012

Related U.S. Application Data

(60) Provisional application No. 61/374,102, filed on Aug. 16, 2010.

(51) Int. Cl.
*C22C 5/02* (2006.01)
*C22C 5/00* (2006.01)

(52) U.S. Cl.
CPC ..... *C22C 5/02* (2013.01)
USPC ..... 420/509; 148/430

(58) Field of Classification Search
USPC ..... 420/509, 510; 148/430
See application file for complete search history.

(56) References Cited

U.S. PATENT DOCUMENTS

| | | | |
|---|---|---|---|
| 4,412,970 | A | 11/1983 | Prasad |
| 4,681,735 | A | 7/1987 | Groll et al. |
| 4,836,984 | A | 6/1989 | Wagner et al. |
| 5,139,891 | A | 8/1992 | Cowie et al. |
| 5,298,218 | A | 3/1994 | Groll et al. |
| 6,585,755 | B2 | 7/2003 | Jackson et al. |
| 6,849,231 | B2 | 2/2005 | Kojima et al. |
| 6,982,059 | B2 | 1/2006 | Liang et al. |
| 7,087,077 | B1 | 8/2006 | Van Dijk et al. |
| 7,128,757 | B2 | 10/2006 | Boylan et al. |
| 2004/0153138 | A1 | 8/2004 | Murphy |
| 2005/0070793 | A1 | 3/2005 | Pacetti et al. |
| 2005/0121120 | A1 | 6/2005 | Van Dijk et al. |
| 2005/0222656 | A1 | 10/2005 | Wahlstrand et al. |
| 2005/0222657 | A1 | 10/2005 | Wahlstrand et al. |
| 2006/0247748 | A1 | 11/2006 | Wahlstrand et al. |
| 2007/0162108 | A1 | 7/2007 | Carlson et al. |
| 2007/0280850 | A1 | 12/2007 | Carlson |
| 2008/0049376 | A1 | 2/2008 | Stevenson et al. |
| 2008/0188924 | A1 | 8/2008 | Prabhu |
| 2008/0195194 | A1 | 8/2008 | Pacetti et al. |
| 2009/0191087 | A1 | 7/2009 | Klein et al. |

FOREIGN PATENT DOCUMENTS

| | | | |
|---|---|---|---|
| DE | 32 11 703 | A1 | 10/1983 |
| DE | 34 47 413 | A1 | 6/1986 |
| DE | 10033445 | A1 * | 1/2002 |
| JP | 09184033 | A | 7/1997 |
| WO | WO 2007/070544 | A | 6/2007 |

OTHER PUBLICATIONS

Trampert et al., English machine translation of DE10033445, Jan. 24, 2002, p. 1-6.*

Knosp et al., English machine translation of DE3211703, Oct. 20, 1983, p. 1-5.*

Trampert et al., English translation of DE 10033445, Jan. 24, 2002, p. 1-14.*

Wright, Roger N. "9.5 Projecting Workability From Mechanical Tests", appears in "Chapter 9: Workability in Extrusion and Wire Drawing" of *Workability Testing Techniques*, Dieter, George E. ed., American Society for Metals 1984 pp. 262-268.

Spencer, J.F. et al. "The magnetic susceptibility of some binary alloys", Proceedings of the Royal Society of London, Series A, containing papers of a mathematical and physical character, vol. 115, No. 773, pp. 61-73 (1927).

Harris, I.R. et al. "A study of some palladium-tin, silver-tin and palladium-silver-tin alloys," *Journal of the Less Common Metals*, Elsevier-Sequoia S.A. Lausanne, CH, vol. 16, No. 3, Nov. 1, 1968, pp. 223-232. (XP024071078, ISSN: 0022-5088).

Schenck, J.F. The role of magnetic susceptibility in magnetic resonance imaging: MRI magnetic compatibility of the first and second kinds, *Medical Physics*, AIP, Melville, NY, US, vol. 23, No. 6, Jun. 1, 1996, p. 815-850. (XP000597979, ISSN: 0094-2405).

* cited by examiner

*Primary Examiner* — Roy King
*Assistant Examiner* — Caitlin Kiechle
(74) *Attorney, Agent, or Firm* — Bridget M. Hayden; Dorsey & Whitney LLP

(57) ABSTRACT

Alloys and dental copings or abutments formed of alloys include 50-60 wt % gold, 5-14 wt % platinum, 0.1-3.0 wt % iridium and the remainder palladium. Other alloys and dental copings or abutments formed of alloys include 58 wt % gold, 10 wt % platinum, 1.0 wt % iridium, and 31 wt % palladium. The alloys are capable of withstanding temperature profiles during casting and multiple high temperature exposures of porcelain firing without excessive softening. The alloys also exhibit advantageous shear strain properties giving the alloys improved manufacturability characteristics.

14 Claims, 4 Drawing Sheets

FIG. 1

| Alloy | Au (+/-1 wt%) | Pd (+/-1) | Pt (+/-1) | Ir (+/-.5) | Other |
|---|---|---|---|---|---|
| Alloy 5810 | 58 | 31 | 10 | 1 | |
| Alloy 6019 | 60 | 20 | 19 | 1 | |
| Epic | 58.7 | 25.1 | 5.2 | 0.25 | 10.75 Ag |
| PE-1601 | 12.5 | 43.5 | 43 | 1 | |
| PE-1602 | 62 | 27 | 10 | 1 | |
| PE-1620 | 63.5 | 30.5 | 5 | 1 | |
| PE-1654 | 40 | 28.5 | 30 | 1.5 | |
| PE-1655 | 36 | 47.5 | 15 | 1.5 | |

FIG. 2

| Alloy | Condition | Tensile Strength (ksi) |
|---|---|---|
| Alloy 5810 | 85% Cold Worked (CW) | 100 |
| Alloy 6019 | 85% CW | 107 |
| PE-1602 | 85% CW | 83 |

FIG. 3

| Parameter | Value |
|---|---|
| Spindle Speed | 8600 RPM |
| Feed Rate | 10 in/min |
| Pass Height | 0.006 in |
| Step Over | 0.02 in |
| Total Approximate Volume Machined | 0.0065 $in^3$ |

FIG. 4

| Alloy | Max Spindle "Output" (mV) |
|---|---|
| Alloy 5810 | 750-1000 |
| Alloy 6019 | 750-850 |
| PE-1601 | Over Load (>2200) |
| PE-1602 | <750 |
| PE-1654 | >1500 |
| PE-1655 | >1500 |

| Sample Number | Alloy | Sag Deflection (in) |
|---|---|---|
| 1 | Alloy 6019 | 0.017 |
| 2 | Alloy 6019 | 0.030 |
| 3 | Alloy 5810 | 0.001 |
| 4 | Alloy 5810 | 0.002 |
| 5 | PE-1620 | 0.007 |

FIG. 7

| Alloy 5810 | | | |
|---|---|---|---|
| **Condition** | **Initial Diameter (in)** | **Fracture Diameter (in)** | **True Strain** |
| 98% Cold Worked (CW) | 0.1868 | 0.0708 | 1.94 |
| 98% CW | 0.1868 | 0.0760 | 1.80 |
| Annealed, 1150 °C | 0.1866 | 0.0266 | 2.50 |
| 17% CW | 0.1696 | 0.0269 | 2.30 |
| 31% CW | 0.1553 | 0.0241 | 2.31 |
| 44% CW | 0.1407 | 0.0221 | 2.34 |
| 55% CW | 0.1244 | 0.0203 | 2.28 |
| 64% CW | 0.1109 | 0.0185 | 2.23 |
| 70% CW | 0.1019 | 0.0164 | 2.26 |
| 81% CW | 0.0816 | 0.0139 | 2.21 |
| 90% CW | 0.0595 | 0.0274 | 1.55 |
| 93% CW | 0.0507 | 0.0255 | 1.37 |
| 96% CW | 0.0358 | 0.0169 | 1.50 |

FIG. 8

| Alloy 6019 | | | |
|---|---|---|---|
| **Condition** | **Initial Diameter (in)** | **Fracture Diameter (in)** | **True Strain** |
| 98% Cold Worked (CW) | 0.1868 | 0.1048 | 1.16 |
| 98% CW | 0.1868 | 0.0984 | 1.28 |
| Annealed, 1150°C | 0.1868 | 0.0464 | 1.38 |
| 17% CW | 0.1695 | 0.0452 | 1.31 |
| 31% CW | 0.1551 | 0.0844 | 1.22 |
| 44% CW | 0.1399 | 0.0819 | 1.07 |
| 55% CW | 0.1248 | 0.0752 | 1.01 |
| 64% CW | 0.1112 | 0.0666 | 1.03 |
| 70% CW | 0.1012 | 0.0599 | 1.05 |
| 81% CW | 0.0802 | 0.0504 | 0.93 |
| 90% CW | 0.0588 | 0.0327 | 1.17 |
| 93% CW | 0.0503 | 0.0280 | 1.17 |
| 96% CW | 0.0354 | 0.0202 | 1.12 |

| Alloy 5810 | | | | |
|---|---|---|---|---|
| **Condition** | **Turns** | **Time (sec)** | **Strain Rate ($sec^{-1}$)** | **Shear Strain** |
| Annealed (Ann), 1150°C | 18.75 | 53 | 0.14 | 7.4 |
| Ann 1150°C | 15.25 | 36 | 0.20 | 7.0 |
| Ann 1150°C | 10.25 | 23 | 0.20 | 4.7 |
| Ann 1150°C | 9.5 | 20 | 0.22 | 4.4 |
| | | | | |
| 98% Cold Worked (CW) | 16.25 | 32 | 0.20 | 6.4 |
| 98% CW | 14.25 | 28 | 0.20 | 5.6 |
| 98% CW | 11.25 | 23 | 0.19 | 4.4 |

| Alloy 6019 | | | | |
|---|---|---|---|---|
| **Condition** | **Turns** | **Time (sec)** | **Strain Rate ($sec^{-1}$)** | **Shear Strain** |
| Annealed (Ann), 1150°C | 9.5 | 30 | 0.12 | 3.7 |
| Ann 1150°C | 7.75 | 16 | 0.22 | 3.5 |
| Ann 1150°C | 5.75 | 14 | 0.18 | 2.6 |
| Ann 1150°C | 6.5 | 13 | 0.22 | 2.9 |
| | | | | |
| 98% CW | 2.25 | 7 | 0.13 | 0.9 |
| 98% CW | 3 | 8 | 0.15 | 1.2 |
| 98% CW | 3 | 7 | 0.17 | 1.2 |

GOLD-BASED ALLOY, FREE OF SILVER AND TIN, FOR DENTAL COPINGS OR ABUTMENTS

RELATED APPLICATIONS

This application claims priority under 35 U.S.C. §119(e) to U.S. Provisional Application Ser. No. 61/374,102 filed Aug. 16, 2010, which is herein incorporated by reference in its entirety.

TECHNICAL FIELD

Dental alloys are provided herein, and more specifically, this disclosure provides gold-based alloys for dental copings or abutments.

BACKGROUND

Dental implant systems generally include three major components: an implant, a coping or abutment, and a cast on structure (e.g., a crown).

The implant itself is generally made of Ti and generally has both external and internal threads. The implant is screwed into a hole that has been drilled into the jaw. Through a process called osseointegration, the $TiO_2$ that naturally forms on the outer surface of the external implant threads chemically bonds to the bone. This process can be enhanced via a number of chemical coatings.

On top of the implant is an abutment or coping. This is a precision-machined component that serves a number of important functions. First, it generally has a number of geometric features such as a hex, square, etc, that mate with a similar feature on the implant. This serves to properly orient the abutment when it is placed on the implant and to maintain that geometric relationship throughout the fabrication and installation process. Second, the abutment serves as a base for holding additional material that forms the tooth anatomy or crown. Third, the abutment is attached to the implant using a screw that attaches to internal threads within the implant. The screw technique is favored because it allows for potential replacement of the abutment/tooth structure without the need to physically remove the implant from the jaw.

The abutment also serves as the carrier for the cast on structure created by the dentist or dental lab to mimic the natural anatomy of a tooth. Generally, the dentist will take an impression of the patient's mouth and create a wax model of the tooth geometry that they wish to create for the tooth. The wax model is formed on top of the abutment. Wax sprues are attached to tooth model and the assembly is invested into a refractory slurry and allowed to dry. The sprues are designed to exit one end of the investment once it has fully hardened. This unit is placed into a burnout oven and the wax is evaporated from the unit, thereby creating a negative three-dimensional image of the tooth anatomy and sprues. The sprues create a path for casting molten metal onto the abutment. Depending on the type of alloy used, casting temperatures can range from below 1000° C. to over 1400° C. (1800° F. to 2550° F.).

Because the abutment must maintain the precise seating geometry to minimize any crevices from forming between the abutment and the implant, it is important that the abutment does not distort or soften significantly during the cast on process. Otherwise, any such pockets could provide sites for bacterial growth. The seating surface also acts to transfer chewing stresses from the crown to the jaw. Asymmetric stresses associated with warping of the seating surface can reverse the osseointegration process. A high solidus temperature tends to help reduce thermal distortion during casting.

After casting, crown and bridge ("C&B") alloys may be polished and placed in the mouth with the natural metal finish exposed. However, in many applications, the patient prefers the look of a natural tooth. In these cases, the tooth anatomy and aesthetics are developed by placing multiple layers of porcelain over top of the casting. This practice is called porcelain fused to metal ("PFM") or PFM restorations. The porcelain firing process uses multiple high temperature cycles in the range of 980° C. (1800° F.). Because of the need to maintain shape during the porcelain firing, PFM alloys tend to have higher solidus temperatures than the C&B alloys, and therefore are cast on to the abutment using higher casting temperatures. The porcelain firing is also done in a temperature range that can anneal and soften the abutment, thereby reducing its ability to stand up to the high chewing stresses without mechanical distortion.

SUMMARY

Accordingly, an alloy for dental applications capable of withstanding both temperature profiles during casting and multiple high temperature exposures of porcelain firing without excessive softening is provided herein. The alloy is also machinable, allowing the alloy to be used as a dental coping or abutment in, for example, dental implant systems.

According to one embodiment, an alloy includes 50-60 weight percentage ("wt %") gold, 5-14 wt % platinum, 0.1-3.0 wt % iridium and the remainder palladium.

In another embodiment, an alloy includes about 58 wt % gold, 10 wt % platinum, 1 wt % iridium, and 31 wt % palladium.

According to another embodiment, a dental coping includes an alloy comprising 50-60 wt % gold, 5-14 wt % platinum, 0.1-3.0 wt % iridium and the remainder palladium.

In yet another embodiment, a dental abutment includes an alloy comprising about 58 wt % gold, 10 wt % platinum, 1 wt % iridium, and 31 wt % palladium.

While multiple embodiments are disclosed herein, still other embodiments will become apparent to those skilled in the art from the following detailed description, which shows and describes illustrative embodiments. As will be realized, by those of ordinary skill in the art upon reading the following disclosure, the embodiments are capable of modifications in various aspects. Accordingly, the drawings and detailed description are to be regarded as illustrative in nature and not restrictive.

DESCRIPTION OF THE DRAWINGS

FIG. 1 is a table representing the alloy chemistries of abutment alloys, experimental and commercial.

FIG. 2 is a table of tensile strengths illustrating how PE-1601 has a lower than desired tensile strength.

FIG. 3 lists the machining parameters used for machinability testing.

FIG. 4 lists the spindle output values measured from machinability tests.

FIG. 7 is a table illustrating, for Alloy 5810, data for reduction in area from tensile tests.

FIG. 8 is a table illustrating, for Alloy 6019, data for reduction in area from tensile tests.

DETAILED DESCRIPTION

Figures 5, 6:
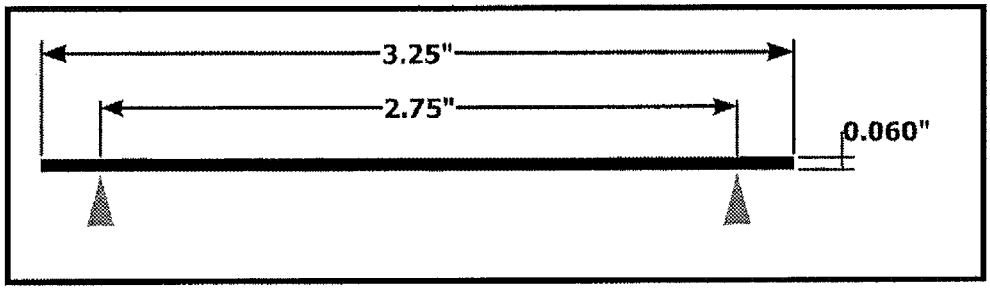
FIG. 5 illustrates the sag test configuration.
FIG. 6 contains sag data for Alloy 5810, Alloy 6019, and PE-1620.

Provided herein are alloys composed primarily of gold, which also include platinum, iridium, and palladium. As described below, the gold-based alloys provided herein exhibit advantages over other alloys due, in part, to the gold-based alloy having a relatively high melting point and improved manufactuability. The gold-based alloys may be provided alone or as a dental abutment or coping, and may include cast on metal with or without a porcelain layer fused or otherwise fixed on the dental abutment or coping.

According to certain embodiments, a gold-based alloy or a dental abutment or coping formed of a gold-based alloy includes (in wt %) 50-60 gold, 5-14 platinum, 0.1-3 iridium, and the balance palladium. In other embodiments, a gold-based alloy or a dental abutment or coping formed of a gold-based alloy includes (in wt %) 58 gold, 10 platinum, 1.0 iridium, and 31 palladium. In alternative embodiments, gold is provided (in wt %) between about 50-60, 50-55, 57-59, 55-60, or at about 51, 52, 53, 54, 55, 56, 57 58, 59 or 60 (+/−1); platinum is provided (in wt %) between about 5-14, 5-10, 10-14, or at about 5, 6, 7, 8, 9, 10, 11, 12, 13 or 14 (+/−1); iridium is provided (in wt %) between about 0.1-3.0, 0.1-1, 1-2, 2-3, or at about 0.1, 0.25 0.5, 0.75, 1.0, 1.25, 1.50, 1.75, 2.0, 2.25, 2.5, 2.75, or 3.0; and palladium is provided (in wt %) between about 23-42, 23-30, 30-40, 30-35, or at about 23, 24, 25, 26, 27, 28, 29, 30, 31, 32, 33, 34, 35, 36, 37, 38, 39, 40, 41, or 42. It will be understood that the various elemental amounts provided above may be values of approximation, and thus may encompass elemental amounts corresponding to at least the above-identified enumerated values (e.g., palladium is provided (in wt %) at least at about 23, 24, 25, 26, 27, 28, 29, 30, 31, 32, 33, 34, 35, 36, 37, 38, 39, 40, 41, or 42). Such alloys may have trace impurities below a total of 2000 ppm.

In contrast to the dominant mass produced "gold" abutment alloy, Alloy 6019 (see FIG. 1), this disclosure provides alloys (e.g., Alloy 5810) with increased high temperature strength, increased ductility/workability, compatibility with more dental casting alloys (i.e. higher solidus) and resistance to discoloration during high temperature treatment.

While some available alloys used in abutment applications offer advantages over Alloy 6019, most are not appropriate for mass production. This disclosure provides alloys that offer improved manufacturability, while maintaining other necessary properties for abutment alloys. Those other properties include acceptable room temperature mechanical properties, chemical compatibility with dental casting alloys and porcelains, plus a coefficient of thermal expansion ("CTE") and melting temperature appropriate for both C&B and PFM dental systems.

The gold-based alloys provided herein are also free of silver and tin making it suitable for dental applications in which the alloy is subjected to multiple cycles of high temperatures. Other abutment alloys containing silver and tin generally have low melting points and do not have compatibility with high temperature dental restoration materials.

To maintain strength, the gold content in the gold-based alloys provided herein should be fixed at a maximum of about 60 wt %. In general, increasing the gold content beyond 60 wt % lowers the alloys strength. For example PE-1602 (FIGS. 1 and 2) has a tensile strength lower than desirable for the application, below 590 MPa (85 ksi) in the cold worked condition.

Processing conditions can impact the final alloy strength. For example, Alloy 5810 cast at a size greater than 25 mm (1 in) in diameter, and processed in a particular manner can have a tensile strength between about 620 to 690 MPa (90 to 100 ksi). Alternatively, Alloy 5810 cast at a diameter of 12.5 mm (0.5 in), and processed in the same manner (identical cold work reduction percentages and annealing temperatures) as the above example, can have a tensile strength of about 814 MPa (118 ksi). Considering these possible variations it was determined that alloys such as PE-1601 have a cold worked tensile strength below the desirable level.

It will be understood, however, that the Alloy 5810 as well as other alloys provided herein may be cast in any diameter and/or shape. It will also be understood that as an alternative to casting, the alloys provided herein may be wrought into bar, rod or wire form in any diameter.

It is also important to consider what the approximate strength of the alloy will be after it has been subjected to PFM metal cast-on and porcelain firing in the dental lab. To simulate the thermal cycling done to make the restoration, in order to measure "final" material properties, a fired three times ("F3X") test is performed where the gold-based alloy is cycled between 650° C. and 980° C., at 55° C./min (1200° F. and 1800° F., at 100° F./min) three times. For a 0.060" diameter wire (~85% cold worked) given an F3X treatment, Alloy 6019 (the predominant commercial gold abutment alloy) softens approximately 27%, compared to Alloy 5810, which softens approximately 15%. That means to achieve the same tensile strength, for instance 690 MPa (100 ksi), after F3X, the Alloy 6019 material is required to have a tensile strength of 924 MPa (134 ksi), where Alloy 5810 of the present disclosure would only require a tensile strength of 814 MPa (118 ksi). The alloys provided herein accordingly exhibit increased resistance to softening compared to those commonly used in practice, allowing for more flexibility in the as-manufactured tensile strength to achieve a given tensile strength after F3X treatment. This reduced requirement in "as-manufactured" strength also improves the degree of flexibility allowed in the manufacturing operation.

In general, a high alloy solidus temperature is desirable, especially for PFM dental restorations that subject the abutment to high temperature during processing. The higher the solidus temperature of the abutment material, the greater flexibility the dentist/dental lab has in choosing the PFM casting alloy. As discussed above, Alloy 6019 replaced alloys such as Epic (FIG. 1), because of a solidus increase to 1400° C. (2550° F.) from 1350° C. (2460° F.), respectively. Alloys provided herein can result in a further increase of the solidus temperature to approximately 1425° C. (2600° F.).

The disclosed chemistries provide a high degree of manufacturability, which generally includes but is not limited to machinability (e.g., finished part fabrication) and workability (e.g., any deformation processing). Each of machinability and workability are described below.

To efficiently produce a high volume of abutments, machining tool wear needs to be limited, and alloys thus require a high degree of machinability. By studying the alloys of the present disclosure, it has been determined that the concentration of gold controls the machinability of Au—Pd—Pt—Ir alloys. It has also been found that with a fixed concentration of Ir, increases in Pt and Pd generally decrease the machinability. More specifically, a machinability test was developed and compares the degree of tool wear using the alloys provided herein relative to the most widely used gold abutment alloy, Alloy 6019. A minimum of 50 wt % Au provides an alloy that induces little tool wear over a length of time that is compatible with efficient production. For each alloy tested in the machining experiments, the volume of material machined, the machine tool material/geometry, lubricant, and machining parameters ("feeds and speeds") were kept constant. Machining was done on a CNC mill using a 3.175 mm (0.125 in) diameter, square end, solid carbide end mill. The machining parameters are listed in FIG. 3.

The machinability was then evaluated by combining the machine's electric spindle "output" (a voltage proportional to electrical load on the spindle motor, i.e. ease of machining) vs. time, and the machine tool wear after the experiment. It was found that the maximum spindle "output" during the test corresponds to the degree of tool wear. Tool wear data shows that with increasing combined palladium and platinum content to over approximately 50 wt %, tool wear is increased such that tool life (the number of parts that can be machined to meet part specification) would be reduced by at least 30% (FIG. 4). The best alloys provide similar performance to Alloy 6019 and the worst alloys (represented by other abutment alloys) could not complete the test due to overloading of the machine spindle. Any alloys that exhibited a max spindle load over approximately 1000 mV would not be acceptable for production.

To prevent dimensional distortion of the alloy during the cast-on and porcelain firing operations, it is desirable to have an alloy with maximum high temperature strength. Increasing the palladium content improves the high temperature strength. One measure of an alloy's high temperature strength is creep resistance, for which one can perform a "sag" test. Accordingly, the Alloy 5810 was tested compared to Alloy 6019, and PE-1620 (FIG. 1), by heating straight rods (i.e. one that rolls freely when pushed on a flat table) suspended between two points and qualitatively analyzing the deflection of the rod after it has cooled. Rods with a diameter of 1.524 mm (0.060 in), approximately 82 mm (3.25 in) long, with an unsupported span of 70 mm (2.75 in), were heated to 980° C. (1800° F.), in air, and held for 1 hr. After they were cooled to room temperature the Alloy 6019 rod had sagged between 0.43 mm to 0.76 mm (0.017 to 0.030 in) and would no longer roll freely when pushed on a flat table. The Alloy 5810, had sagged between 0.03 mm to 0.05 mm (0.001 to 0.002 in), and would still roll freely when pushed on a flat table. A third alloy tested, PE-1620, exhibited an intermediate amount of sag, measured at 0.18 mm (0.007 in). FIG. 5 illustrates the sag test. FIG. 6 contains the data for Alloy 5810, Alloy 6019, and PE-1620. Based on the increased sag of higher gold alloys (i.e. above approximately 60 wt %), alloys such as Alloy 5810 provide improved sag resistance, exhibiting deformations less than about 0.127 mm (0.005 in) for the above test.

Additionally, of importance to dental practitioners and their patients is the color of the metal before and after thermal treatment. For instance for the same conditions used in the "sag" test, the Alloy 5810 is brighter (more reflective) than the Alloy 6019 sample. For the most part alloy color is an aesthetic property that is generally associated with quality and attractiveness.

The alloy compositions provided herein (e.g., Alloy 5810) exhibit improved workability over the Alloy 6019. The improved workability makes them more manufacturable. To present an objective measure of workability, two methods were used: 1) a uniaxial tension test to measure reduction in area at fracture; and 2) torsional strain to fracture ("twisting") was measured. The use of both uniaxial tensile and torsion testing is a complementary approach because a tensile test's reduction in area is related to the resistance to accumulating internal damage; and the torsion test is sensitive to surface-region fracture resistance. Wright, Roger N., Workability Testing Techniques, 262-268 (Dieter, George E, 1984).

The tensile tests were performed for various metallurgical conditions, comparing the properties of the alloys provided herein (Alloy 5810) to Alloy 6019. The tensile tests were performed at a cross head speed of 5 mm/min (0.2 in/min). Reduced area measurements were made by fitting the tensile specimen back together after fracture and measuring the minimum diameter on a light microscope. The reduced area true strain to fracture was calculated with the equation $\epsilon = \ln(A_o/A_1)$; where $\epsilon$ is the true strain, $A_o$ is the initial cross sectional area of the tensile specimen, and $A_1$ is the cross sectional area at the minimum diameter of the fractured specimen.

FIG. 7 and FIG. 8 show the tensile reductions in cross sectional area, and metallurgical condition (e.g., annealed or % cold worked), for the individual tests. Alloy 5810, when annealed at 1150° C., exhibits a reduction of cross-sectional area of 2.50 units of true strain. In comparison, Alloy 6019 subjected to the same conditions exhibits a reduction of cross-sectional area of 1.38 units of true strain. When cold worked, Alloy 5810 exhibits a reduction in cross-sectional area of between about 2.30 and 1.37 true strain units. In comparison, Alloy 6019 subjected to the same cold working conditions, exhibits a reduction in cross-sectional area of between about 1.31 and 0.93 true strain units. The results of the tensile test consistently indicate that the true cross sectional strain (reduction in cross-sectional area) to failure for Alloy 5810 is on average 2 times greater than Alloy 6019 from annealed material to an 80% level of cold work.

The torsion tests were performed on a miniature lathe-type fixture. In the test one end of the sample is prevented from rotating (i.e. radially fixed), the other end may then be rotated by hand. The non-rotating (radially fixed) end is not axially fixed, minimizing any tensile or compressive stress that may result from a variation in the length of the sample during the test. The rotational speed (strain rate) is controlled by the operator. An average strain rate (total strain divided by test time) is reported for each test. The number of twists required to cause fracture of the samples is then counted (rounded to the nearest quarter turn). The total shear strain to fracture is calculated by: $\gamma = RT2\pi/L$, where $\gamma$ is the total shear strain, R is the specimen radius in the gauge length, T is the number of turns to failure, $2\pi$ converts turns (T) to radians, and L is the specimen gauge length. The samples (FIG. 9) have a nominal gauge length of 25 mm (1 in), an original diameter of 4.7 mm (0.187 in), a reduced diameter of 3.2 mm (0.125 in), and a shoulder fillet radius of 2.5 mm (0.1 in). All samples were cut using the same method, on a traditional machinists lathe.

Figures 9, 10, 11:
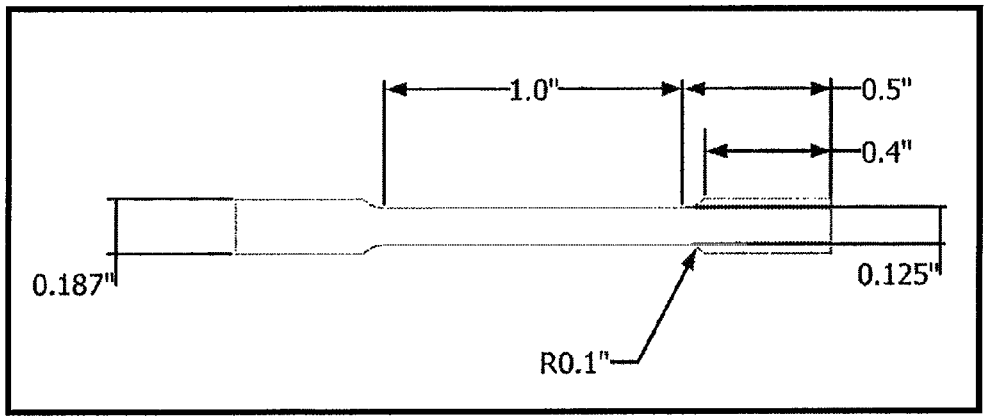
FIG. 9 illustrates cylindrical twist test specimen geometry.
FIG. 10 illustrates Alloy 5810 twist test results.
FIG. 11 illustrates Alloy 6019 twist test results.

FIG. 10 and FIG. 11 show the shear strain data for the individual samples tested. Alloy 5810, when annealed at 1150° C., exhibits between about 7.4 and 4.4 shear strain units Alloy 5810, after 98% cold working, exhibits between about 4.4 and about 6.4 shear strain units. The results of the torsion tests showed that the alloy exhibits a torsional shear strain to fracture of greater than 4 units of shear strain; on average, annealed Alloy 5810 can sustain 1.8 times more shear strain than annealed Alloy 6019; and 98% cold worked Alloy 5810 can sustain over 5 times more shear strain than 98% cold worked Alloy 6019. It is notable that Alloy 5810 in the cold worked condition can sustain more shear strain than Alloy 6019 in the annealed condition.

The alloy compositions according to the present disclosure provide a combination of properties unique to the ratio of the chemical constituents. The gold alloys contain (wt %) 50-60 gold, 5-14 platinum, 0.1-3.0 iridium, and the remainder palladium, e.g., between about 23-42 wt % or about 31 wt %. In addition to advantageous true strain and shear strain (manufacturability/workability) properties, these compositions provide an alloy with the required F3X strength, a coefficient of thermal expansion of approximately 12.3 μm/m ° C. (6.89 μin/in ° F.), high temperature strength, melting temperature (solidus) above 1425° C. (2600° F.), good machinability, and color/resistance to discoloring.

Although the present disclosure provides references to preferred embodiments, persons skilled in the art will recognize that changes may be made in form and detail without departing from the spirit and scope of the invention.

What is claimed is:

1. A dental alloy for copings or abutments comprising 50-60 wt % gold, 5-14 wt % platinum, 0.1-3.0 wt % iridium and the remainder palladium, wherein the dental alloy is free of tin and silver and has a solidus temperature above 1425° C.

2. The dental alloy of claim 1, wherein the dental alloy exhibits a torsional shear strain to fracture of greater than 4 units of shear strain.

3. The dental alloy of claim 1, wherein palladium is present between 23-42 wt %.

4. The dental alloy of claim 1, wherein palladium is present in the dental alloy in an amount of at least 30 wt %.

5. The dental alloy of claim 1, wherein the dental alloy is wrought into bar, rod or wire form.

6. The dental alloy of claim 1, wherein trace impurities of the dental alloy are below a total of 2000 ppm.

7. A dental alloy for copings or abutments comprising about 58 wt % gold, 10 wt % platinum, 1 wt % iridium, and 31 wt % palladium, wherein the dental alloy is free of tin and silver and has a solidus temperature above 1425° C.

8. A dental abutment including an alloy comprising 50-60 wt % gold, 5-14 wt % platinum, 0.1-3.0 wt % iridium and the remainder palladium, wherein the alloy is free of tin and silver and has a solidus temperature above 1425° C.

9. The dental abutment of claim 8, wherein the alloy exhibits a torsional shear strain to fracture of greater than 4 units of shear strain.

10. The dental abutment of claim 8, further comprising a cast on metal with or without a porcelain layer fused or otherwise fixed on the dental abutment.

11. The dental abutment of claim 8, wherein palladium is present between 23-42 wt %.

12. The dental abutment of claim 8, wherein palladium is present in the alloy in an amount of at least 30 wt %.

13. The dental abutment of claim 8, wherein trace impurities of the alloy are below a total of 2000 ppm.

14. A dental abutment including an alloy comprising about 58 wt % gold, 10 wt % platinum, 1 wt % iridium, and 31 wt % palladium, wherein the alloy is free of tin and silver.

* * * * *

UNITED STATES PATENT AND TRADEMARK OFFICE

CERTIFICATE OF CORRECTION

PATENT NO. : 8,845,959 B2
APPLICATION NO. : 13/050657
DATED : September 30, 2014
INVENTOR(S) : Peter Hale, Edward F. Smith, III and Arthur S. Klein It is certified that error appears in the above-identified patent and that said Letters Patent is hereby corrected as shown below:

Specification

| Column | Line | PTO | Should Be |
|---|---|---|---|
| 6 | 8-9 | "$\varepsilon$=In($A_o/A_1$)" | — $\varepsilon$=ln($A_o/A_1$) — |

Signed and Sealed this
Third Day of February, 2015

Michelle K. Lee

Michelle K. Lee
*Deputy Director of the United States Patent and Trademark Office*